US006817795B2

(12) United States Patent
Korthäuer

(10) Patent No.: US 6,817,795 B2
(45) Date of Patent: Nov. 16, 2004

(54) DEVICE FOR IMPRINTING A STRIP OR LABELS ADHERING TO SAID STRIP

(75) Inventor: Manfred Korthäuer, Mühlheim/Ruhr (DE)

(73) Assignee: Espera-Werke GmbH, Duisburg (DE)

( * ) Notice: Subject to any disclaimer, the term of this patent is extended or adjusted under 35 U.S.C. 154(b) by 0 days.

(21) Appl. No.: 10/467,653

(22) PCT Filed: Dec. 18, 2001

(86) PCT No.: PCT/EP01/14977

§ 371 (c)(1),
(2), (4) Date: Aug. 8, 2003

(87) PCT Pub. No.: WO02/068351

PCT Pub. Date: Sep. 6, 2002

(65) Prior Publication Data

US 2004/0071488 A1 Apr. 15, 2004

(30) Foreign Application Priority Data

Feb. 22, 2001 (DE) ..... 101 09 882

(51) Int. Cl.[7] ..... B41J 11/26

(52) U.S. Cl. ..... 400/613; 400/611
(58) Field of Search ..... 400/611–615.2

(56) References Cited

U.S. PATENT DOCUMENTS

| | | | | |
|---|---|---|---|---|
| 4,772,147 A | | 9/1988 | Ohtani | |
| 5,039,085 A | | 8/1991 | Stellmach | |
| 5,725,321 A | | 3/1998 | Brannan et al. | |
| 5,938,350 A | * | 8/1999 | Colonel | 400/234 |
| 5,988,903 A | | 11/1999 | Baitz et al. | |
| 6,031,555 A | | 2/2000 | Schartner | |
| 6,241,407 B1 | * | 6/2001 | Huggins et al. | 400/611 |
| 6,261,013 B1 | * | 7/2001 | Bryer et al. | 400/613 |
| 6,336,757 B1 | * | 1/2002 | Nishimura et al. | 400/613 |

FOREIGN PATENT DOCUMENTS

| | | |
|---|---|---|
| DE | 3638063 | 5/1987 |
| DE | 3837250 | 3/1990 |
| DE | 19709941 | 9/1998 |

* cited by examiner

*Primary Examiner*—Minh Chau
(74) *Attorney, Agent, or Firm*—Collard & Roe, P.C.

(57) ABSTRACT

A device for imprinting a strip or labels adhering to a strip in which the strip is unwound from a supply roll held by a receiving device and fed to a printing unit. The printing unit can be opened for loading and closed for printing the strip. The printing unit has an automatic actuating device which opens the printing unit as a function of a signal. A holding device securing the supply roll to the receiving device is actuated by an automatic actuating device as a function of a signal so that the holding device releases the supply roll.

15 Claims, 3 Drawing Sheets

DEVICE FOR IMPRINTING A STRIP OR LABELS ADHERING TO SAID STRIP

CROSS REFERENCE TO RELATED APPLICATIONS

Applicant claims priority under 35 U.S.C. §119 of GERMAN Application No. 101 09 882.0 filed on 22 Feb. 2001. Applicant also claims priority under 35 U.S.C. §365 of PCT/EP01/14977 filed on 18 Dec. 2001. The international application under PCT article 21(2) was not published in English.

BACKGROUND OF THE INVENTION

1. Field of the Invention

The present invention relates to a device for imprinting a strip or labels adhering to a strip, in which the strip is unwound from a supply roll and supplied to a printing unit, the supply roll being held by a receiving device and the printing unit can be opened for loading a strip and closed for imprinting the strip or labels adhering to the strip.

2. Prior Art

Printers, as they are typically used in the field of price marking, contain, among other things, a receiving device for the ticket roll (supply roll), which is a flat strip with or without labels adhering thereto, a printing unit, a paper winding device, and an assembly for using thermal transfer film. In order to make the loading of the current ticket roll as simple as possible, the printing unit is typically provided with an opening mechanism. The related art is to open the printing unit through intentional actuation of an actuator, in order to load and/or replace the ticket roll with or without labels. To load the ticket roll, it is placed on an assigned receiving device and possibly fixed there. A specific starting length of the flat strip which forms the ticket roll is guided through the printing unit and attached to a winding device. The winding device may contain a mechanism which simplifies the removal of the flat strip wound thereon. Before the printing procedure may begin, the printing unit must be closed.

SUMMARY OF THE INVENTION

The object of the present invention is to provide a device of the type initially cited, with which the loading and/or changing of a flat strip, with or without labels adhering thereto, is possible in a comfortable way.

This object in achieved by a device having the features disclosed herein. Preferred are advantageous embodiments of the present invention are also disclosed.

This object is achieved by a device having the features of claim 1. Preferred and advantageous embodiments of the present invention are specified in the subclaims.

The present invention is thus essentially that the printing unit of the device is provided with an automatic actuating device which automatically opens the printing unit as a function of a signal, and a holding device, which secures the supply roll on the receiving device during the printing procedure, is automatically actuated by the automatic actuating device or another automatic actuating device as a function of the said signal or another signal, so that the holding device releases the supply roll.

With the device according to the present invention, the strip wound on a supply roll may therefore be placed and/or replaced on the receiving device and the strip may be loaded through the printing unit up to the winding device and fixed easily and comfortably.

The signal which causes the automatic opening of the printing unit and/or the automatic actuation of the holding device to release the supply roll may be generated in various ways. According to a preferred embodiment, the signal is generated using a measurement device which detects the end of the strip and/or using a device which calculates the end of the strip. The measurement device for detecting the end of the strip may preferably have a switch, a touch element, a magnetic sensor, and/or a light barrier in this case.

A further preferred embodiment of the device according to the present invention is that the signal which causes the automatic opening of the printing unit or the automatic actuation of the holding device to release the supply roll is transmitted wirelessly and/or via optical fiber to the respective automatic actuating device. The respective automatic actuating device may preferably be implemented as an electromechanical, electromagnetic, or pneumatic actuating device in this case.

According to a further advantageous embodiment, the device according to the present invention may be implemented in such a way that the automatic opening of the printing unit and the automatic actuation of the holding device to release the supply roll occur at different times. The time delay with which the automatic actuation of the holding device to release the supply roll follows the automatic opening of the printing unit may be fixed or adjustable.

Furthermore, the device according to the present invention may also have a winding device for winding the strip coming out of the printing unit, which is provided with a mechanism for removing the wound strip and with a sensor which detects the position of the mechanism for removing the wound strip. For such an embodiment, the sensor preferably generates the signal which causes the automatic opening of the printing unit or the automatic actuation of the holding device to release the supply roll when the mechanism for removing the wound strip is in a position which is provided for removing the wound strip. Alternatively, leaving the starting position, i.e., the position which is provided for the winding of the strip, may be used for signal generation. All active and passive sensors, as well as switches and/or pneumatic valves, may be used as sensors in this case.

The manipulations of the operator of the device according to the present invention may be reduced to minimum if this device also includes a measurement device which detects the placement of a supply roll on the receiving device and proper loading of the strip and which, in the event of a supply roll positioned on the receiving device and a properly loaded strip, generates a signal which causes automatic actuation of the holding device to secure the supply roll on the receiving device and automatic closing of the printing unit. In this way, the initial loading of a strip and the replacement of a supply roll are optimally supported by the device according to the present invention. The automatic actuation of the holding device to secure the supply roll on the receiving device and the automatic closing of the printing unit may also occur at different times in this case.

After the automatic actuation of the holding device to secure the supply roll, the latter is therefore mechanically fixed, however, it may possibly not yet be optimally seated at the intended position. According to a further advantageous embodiment of the device according to the present invention, a device for automatic alignment of the supply roll on the receiving device is therefore provided. The alignment of the supply roll may advantageously be performed using an electromechanical, electromagnetic, or pneumatic actuating device in this case. A control device of this type may preferably also be used for the automatic closing of the printing unit.

A further advantageous embodiment of the device according to the present invention is that the printing unit is assigned a device for automatic positioning of labels adhering to the band strip in relation to the printing unit.

BRIEF DESCRIPTION OF THE DRAWINGS

In the following, the present invention is described in greater detail on the basis of a drawing which illustrates an exemplary embodiment.

DETAILED DESCRIPTION OF THE INVENTION

Figure 1:
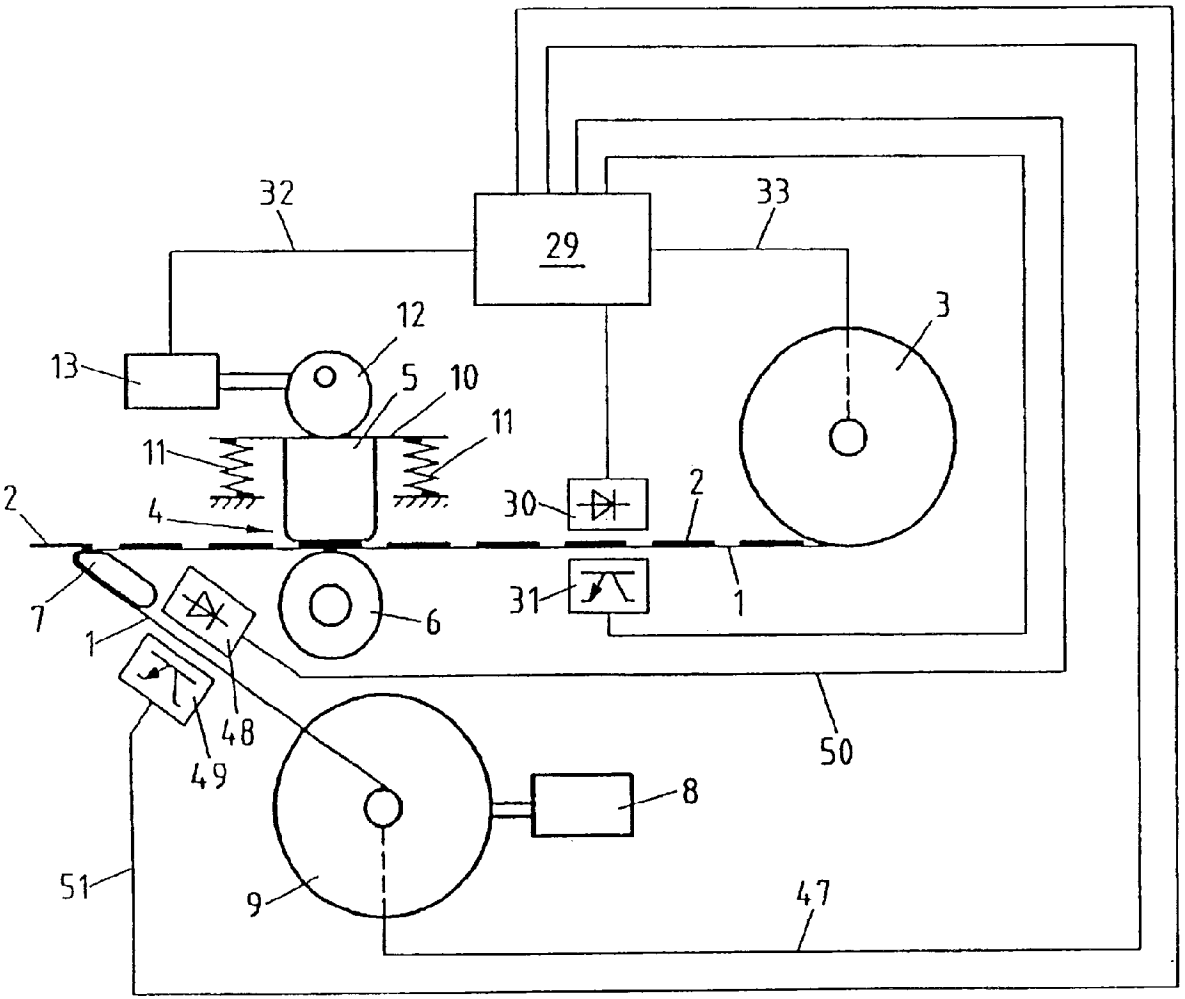
FIG. 1 shows a schematic illustration of a device according to the present invention.

A printer for printing labels 2 adhering to a carrier strip 1 is illustrated in FIG. 1. The strip 1 is unwound from a supply roll 3 and fed to a printing unit 4. The printing unit 4 includes a printing head 5 and a printing roller 6. The printing head 5 presses the labels with sufficient force against the printing roller 6 and imprints them using the thermal or thermal transfer method, for example. The printing roller 6 may be driven by a stepping motor (not shown). A relatively sharp deflection in the form of a dispensing edge 7 is provided in the strip run direction behind the printing unit, on which the printed labels are detached in a way known per se from the carrier strip 1 and may be removed through an opening in the housing of the printer and applied to an object to be identified. After the deflection on the dispensing edge 7, the carrier strip 1 is wound on a winding device 9 driven by a stepping motor 8.

The printing head 5 of the printing unit 4 is attached to a movably mounted plate 10, on which coil springs 11, supported on fixed bearings, engage on the side of the printing head 5. An eccentrically mounted circular disk 12, which may be rotated by a stepping motor 13, is on the other side of the plate 10. Due to the spring action, the printing head 5 is moved away from the printing roller 6 upon rotation of the eccentrically mounted circular disk 12, so that the printing head 5 assumes a sufficiently large distance in relation to the printing roller 6 to be able to guide the strip 1, having the labels 2 adhering thereto, comfortably through the printing unit 4.

Figure 2:
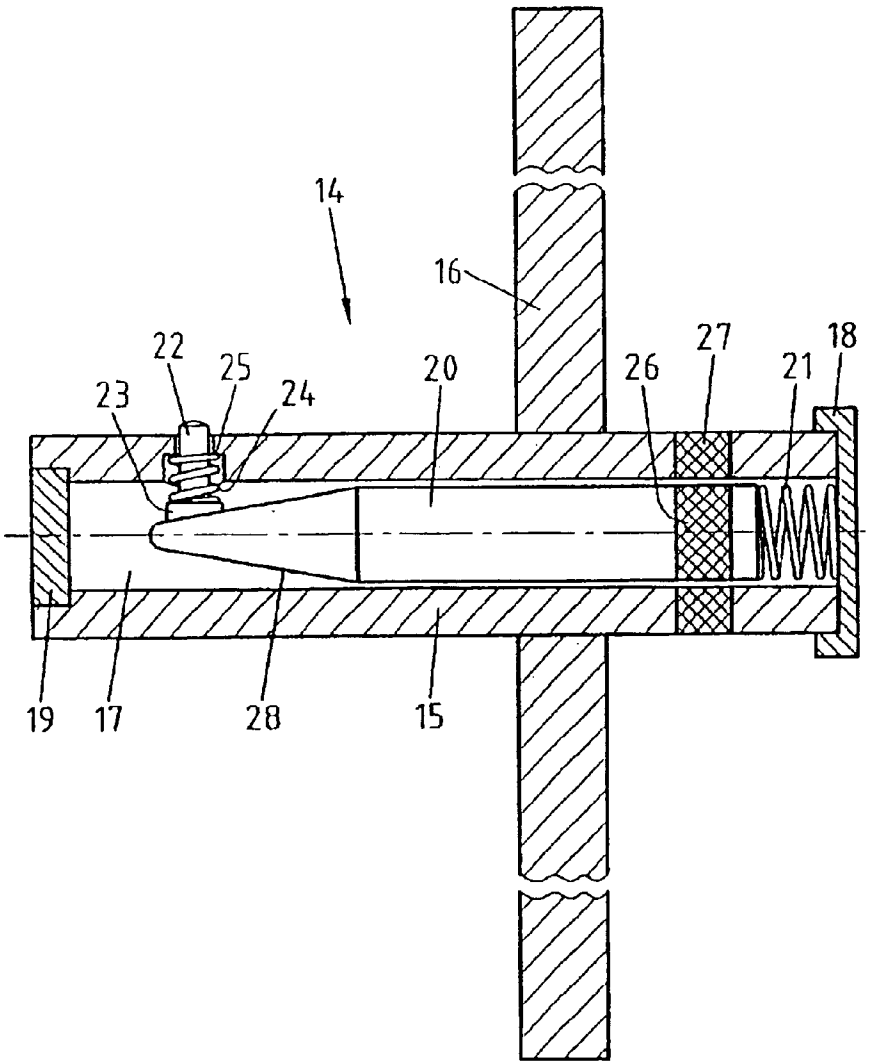
FIG. 2 shows a schematic sectional illustration of a receiving device for receiving a supply roll.

The supply roll 3 is placed on a receiving device which is provided with a holding device which secures the supply roll 3 on the receiving device during the printing procedure. A possible embodiment of the receiving device is schematically illustrated in FIG. 2. The receiving device 14 has a cylindrical receiving core rod 15, which penetrates a bearing disk 16, implemented as circular, for example, and is permanently connected thereto. The receiving core rod 15 has a bore 17 running along its longitudinal axis, whose ends are closed by a cap 18, a screw cap, for example, and a platelike cover 19, respectively. In the bore 17, a pin 20, displaceable in the lengthwise direction, is positioned, which has a coil spring 21, supported on the cover cap 18, applied to it on its face assigned to the cover cap 18. The other end of the pin 20 is implemented as conical and is in contact with a further, smaller pin 22, which is received in a radially positioned through bore of the receiving core rod 15. On its end facing toward the other pin 20, the smaller pin 22 has an enlarged head 23, which a coil spring 24 presses against, which is supported on a shoulder 25 of the radially positioned bore.

The pin 20, displaceable in the lengthwise direction of the receiving core rod 15, has a magnetic section 26 and is otherwise made of a non-magnetic material. The magnetic section 26 is assigned an annular electromagnet 27, which is embedded in the wall of the receiving core rod 15 between the cover cap 18 and the bearing disk 16. Upon activation of the electromagnet 27, the pin 20 is moved against the force of the coil spring 21 in the direction of the cover cap 18, the smaller pin 22 positioned in the radial bore of the receiving core rod 15 moving radially inward due to the effect of the coil spring 24 assigned to it and the conically implemented end of the pin 20. A supply roll placed on the receiving core rod may be removed from the receiving device in this setting of the pins 20, 22. In contrast, if the electromagnet 27 is deactivated, the pin 20, displaceable in the lengthwise direction, moves in the direction of the cover plate 19 at the other end of the receiving core rod 15 due to the effect of the coil spring 21. The head 23 of the small pin 22, whose diameter is enlarged, slides along the conically implemented section 28 of the pin 20 in this case and the pin 22 is thus moved radially outward against the force of the coil spring 24 assigned to it, so that it projects in relation to the lateral surface of the receiving core rod 15. The core of a supply roll 3 positioned on the receiving core rod 15 is mechanically fixed on the receiving device in this way. The supply roll 3 is released via another activation of the electromagnet 27. Only one radially positioned pin 22 is illustrated in FIG. 2. However, the receiving core rod 15 may also be provided with multiple radially positioned pins, with three pins, for example, which each have a spacing of 120° to one another when distributed uniformly around the circumference.

The printing unit 4 of the device and the holding device described above, which secures the supply roll 3 on the receiving device 14 during the printing procedure, are automatically opened and/or actuated as a function of a signal. The signal which causes the automatic opening of the printing unit 4 and automatic actuation of the holding device to release the supply roll 3 is generated in the exemplary embodiment illustrated using a measurement and control device 29 which detects the end of the strip 1 (cf. FIG. 1). For this purpose, the measurement and control device 29 has a light barrier which includes a light-emitting transmitter diode 30 and a receiver diode 31 assigned thereto. If the end of the carrier strip 1 passes the region of the light barrier, the receiver diode 31 receives the light emitted by the transmitter diode 30, upon which a signal is generated in the measurement and control device 29, which is conducted via signal lines 32, 33 to the stepping motor 13 assigned to the eccentrically mounted circular disk 12 and to the electromagnets 27 of the holding device, which secure the supply roll on the receiving device during the printing procedure.

Figure 4:
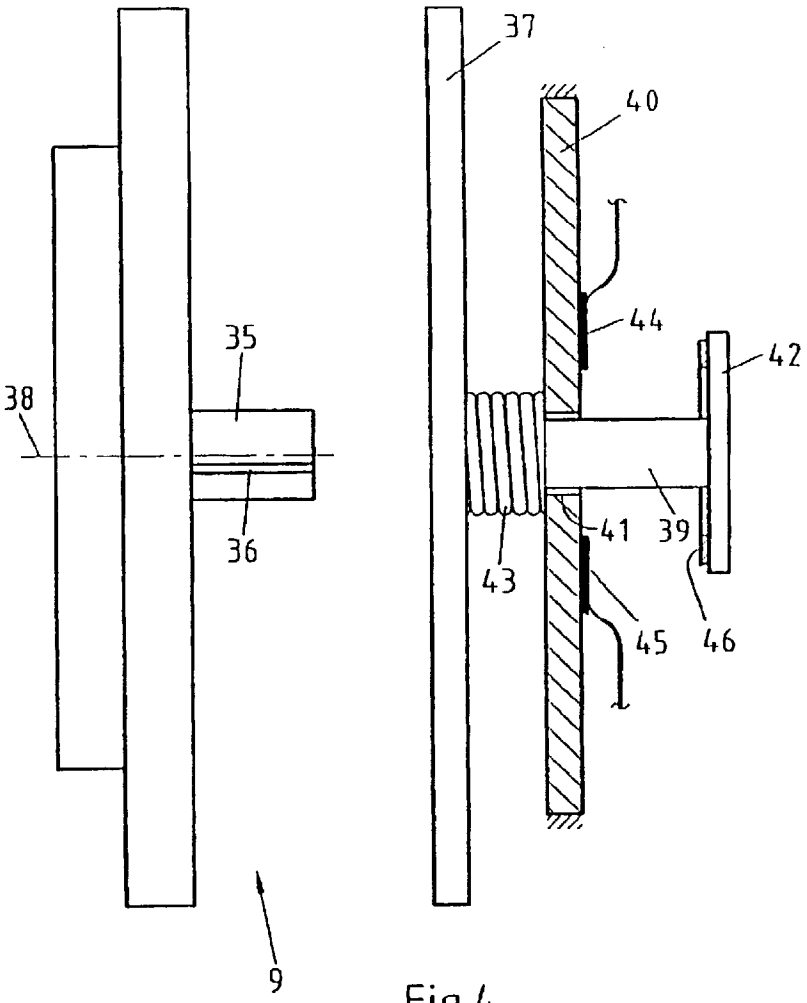
FIG. 4 shows a schematic illustration of the winding device shown in FIG. 3, the mechanism for removing a wound strip being located in a position in which the wound strip may be removed.
Figure 3:
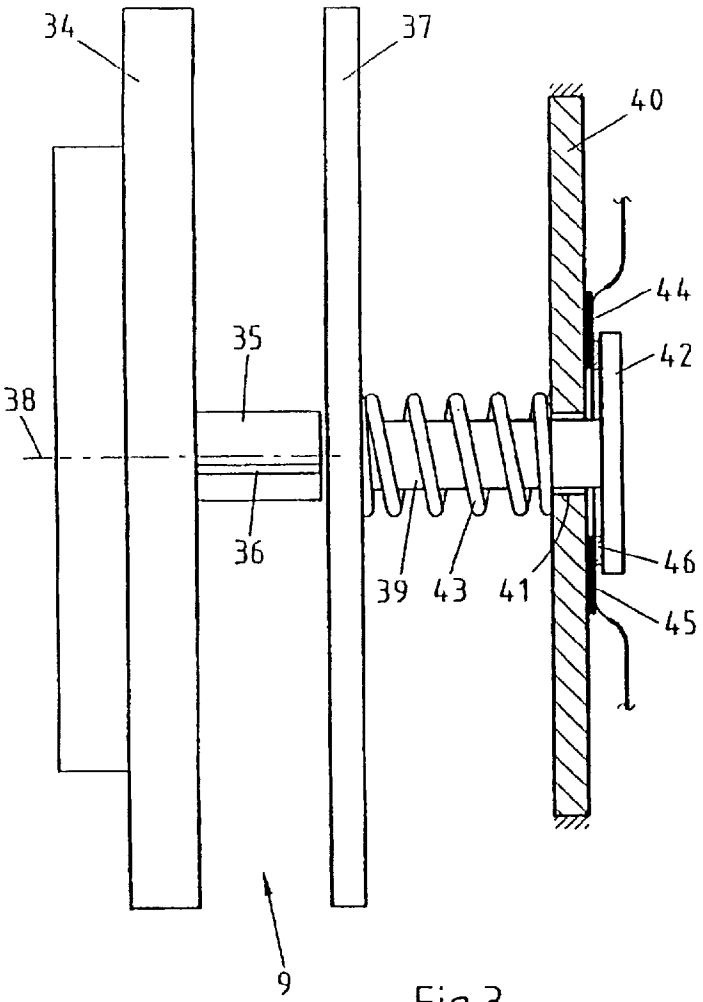
FIG. 3 shows a schematic illustration of a winding device having a mechanism for removing a wound strip.

The winding device 9 schematically illustrated in FIGS. 3 and 4 is provided with a mechanism which is used for removing the strip 1 wound there. The winding device 9 includes a rotatably mounted, circular bearing disk 34 having a centrally positioned cylindrical winding core rod 35, which is provided with a slot 36 for fixing the beginning of the carrier strip 1. The rotatably mounted bearing disk 34 is assigned a second bearing disk 37, running essentially parallel thereto, which is mounted so it is movable in the direction of the axis of rotation 38 of the winding core rod 35. For this purpose, the second bearing disk 37 is provided with a pin 39 on its side facing away from the winding core rod 35, which penetrates a corresponding opening 41 implemented in a holder 40 with play and has a head 42, whose diameter is expanded, on its end facing away from the bearing disk 37. A coil spring 43, placed on the pin 39, is positioned between the holder 40 and the bearing disk 37. The bearing disk 37 may be moved away from the winding core rod 35 against the action of this coil spring 43, as shown in FIG. 4, so that a strip coil (not shown) located on the winding core rod 35 may be removed from the winding device 9.

Two electrical contacts 44, 45 are implemented on the fixed holder 40, which may be short-circuited by an annular conductor 46 implemented on the expanded head 42 of the pin 39 when the bearing disk 37 is pressed in the direction of the winding core rod 35 due to the effect of the coil spring 43 (cf. FIG. 3). A two-wire signal line 47 leads from the electrical contacts 44, 45 to the measurement and control device 29, as shown in FIG. 1. In contrast, if the bearing disk 37 is moved away from the winding core rod 35, as shown in FIG. 4, the electrical connection between the contacts 44, 45 is interrupted. In this way, a signal is generated which may also be used for automatic opening of the printing unit 4 and/or for automatic actuation of the holding device to release the supply roll 3.

As shown in FIG. 1, the measurement and control device 29 is provided with a second light barrier which is positioned between the label dispensing edge 7 and the winding device 9. The light barrier again includes a transmitter diode 48 and a receiver diode 49 assigned thereto, which are connected via signal lines 50, 51 to the measurement and control device 29.

Using the two light barriers, the interrupter switch made of the contacts 44, 45 and the conductor 46, and a sensor (not shown), in the form of a touch switch, for example, positioned on the receiving device 14, the positioning of a supply roll 3 on the receiving device 14 and proper loading of the strip 1 into the printer may be detected and, if there is a supply roll 3 present and a properly loaded strip 1, a signal may be generated in this way which causes automatic actuation of the holding device to secure the supply roll 3 on the receiving device 14 and automatic closing of the printing unit 4. The supply roll 3 is then seated mechanically fixed on the receiving core rod 15 of the receiving device 14, but possibly not yet optimally at the intended position. For optimal alignment of the supply roll 3 on the receiving core rod 15, a mechanism is provided (not shown), which is capable of displacing the position of the entire supply roll 3. This mechanism may be activated electromechanically and/or mechanically and/or pneumatically.

The exemplary embodiment described above makes it clear that the initial loading of a supply roll 3 and/or of a carrier strip 1 and supply roll replacement are optimally supported by a printer according to the present invention. The manipulations of the operator are reduced to a minimum.

The implementation of the present invention is not restricted to the exemplary embodiment described above. Rather, a number of variants are conceivable which make use of the inventive idea as disclosed in the claims, even in the event of fundamentally differing construction.

LIST OF REFERENCE NUMBERS

1 carrier strip
2 labels
3 supply roll
4 printing unit
5 printing head
6 printing roller
7 dispensing edge
8 stepping motor
9 winding device
10 plate
11 coil springs
12 circular disk (eccentrically mounted)
13 stepping motor
14 receiving device
15 receiving core rod
16 bearing disk
17 bore
18 cover cap
19 cover (platelike)
20 pin
21 coil spring
22 pin
23 head
24 coil spring
25 shoulder
26 electromagnetic section
27 electromagnet
28 conically implemented section
29 measurement and control device
30 transmitter diode
31 receiver diode
32 signal line
33 signal line
34 bearing disk
35 winding core rod
36 slot
37 bearing disk
38 axis of rotation
39 pin
40 holder
41 opening
42 pin head (diameter expanded)
43 coil spring
44 electrical contact
45 electrical contact
46 annular conductor
47 signal line
48 transmitter diode
49 receiver diode
50 signal line
51 signal line

What is claimed is:

1. A device for imprinting a strip (1) or labels (2) adhering to a strip, in which the strip is unwound from a supply roll (3) and fed to a printing unit (4), the supply roll being held by a receiving device (14) and the printing unit can be opened for loading a strip and closed for imprinting the strip or labels adhering to the strip, characterized in that the printing unit (4) is provided with an automatic actuating device which automatically opens the printing unit as a function of a signal, and a holding device, which secures the supply roll (3) on the receiving device (14) during the printing procedure, is automatically actuated by the automatic actuating device or another automatic actuating device as a function of the said signal or another signal, so that the holding device releases the supply roll (3).

2. The device according to claim 1, characterized in that the signal which causes the automatic opening of the printing unit (4) or the automatic actuation of the holding device to release the supply roll (3) is generated using a measurement device (29) which detects the end of the strip and/or using a device which calculates the end of the strip.

3. The device according to claim 2, characterized in that the measurement device for detecting the end of the strip has a switch, a touch element, a magnetic sensor, and/or a light barrier (30, 31).

4. The device according to claim 1, characterized in that the signal which causes the automatic opening of the printing unit (4) or the automatic actuation of the holding device to release the supply roll (3) is transmitted to the respective automatic actuating device wirelessly and/or via optical fiber.

5. The device according to claim 1, characterized in that the respective automatic actuating device is an electromechanical, electromagnetic, or pneumatic actuating device.

6. The device according to claim 1, characterized in that the automatic opening of the printing unit (4) and the automatic actuation of the holding device to release the supply roll (3) occur at different times.

7. The device according to claim 1, also including a winding device (9) for winding the strip (1) coming out of the printing unit (4), the winding device (9) being provided with a mechanism which is used to remove the wound strip, and with a sensor which detects the position of the mechanism for removing the wound strip, the sensor generating the signal which causes the automatic opening of the printing unit (4) or the automatic actuation of the holding device to release the supply roll (3) when the mechanism for removing the wound strip (1) is in a position which is provided for the removal of the wound strip (1), or when this mechanism leaves a position which is provided for the winding of the strip (1).

8. The device according to claim 1, also including a measurement device which detects the positioning of a supply roll (3) on the receiving device (14) and proper loading of the strip (1) into the device for printing the strip or labels (2) adhering to the strip (1) and, if a supply roll (3) is positioned on the receiving device (14) and a strip is properly loaded, generates a signal which causes automatic actuation of the holding device to secure the supply roll (3) on the receiving device and automatic closing of the printing unit (4).

9. The device according to claim 8, characterized in that the automatic actuation of the holding device to secure the supply roll (3) on the receiving device (14) and the automatic closing of the printing unit (4) occur at different times.

10. The device according to claim 8, characterized in that the automatic closing of the printing unit (4) is performed using an electromechanical (12, 13) electromagnetic, or pneumatic actuating device.

11. The device according to claim 1, also including a device for automatic alignment of the supply roll (3) on the receiving device (14).

12. The device according to claim 11, characterized in that the alignment of the supply roll (3) is performed using an electromechanical, electromagnetic, or pneumatic actuating device.

13. The device according to claim 1, characterized in that the printing unit (4) is assigned a device for automatic positioning of labels (2) adhering to the strip in relation to the printing unit (4).

14. The device according to claim 1, characterized in that the printing unit (4) may also be opened and closed manually and/or by actuating an actuator.

15. The device according to claim 1, characterized in that the holding device may also be actuated manually and/or by actuating an actuator, so that the holding device secures or releases the supply roll (3) on the receiving device (14).

* * * * *